US006760558B2

(12) United States Patent
Chadani et al.

(10) Patent No.: US 6,760,558 B2
(45) Date of Patent: Jul. 6, 2004

(54) DEVELOPING DEVICE HAVING A COVER WITH PARTITION MEMBER

(75) Inventors: Kazuo Chadani, Shizuoka (JP); Tadayuki Tsuda, Shizuoka (JP); Daisuke Abe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 10/061,159

(22) Filed: Feb. 4, 2002

(65) Prior Publication Data

US 2002/0106222 A1 Aug. 8, 2002

(30) Foreign Application Priority Data

Feb. 8, 2001 (JP) ..... 2001/032510

(51) Int. Cl.[7] ..... G03G 21/18
(52) U.S. Cl. ..... 399/114; 399/119; 399/254
(58) Field of Search ..... 399/111, 113, 399/114, 119, 258, 262, 263, 254, 256

(56) References Cited

U.S. PATENT DOCUMENTS

| | | | | |
|---|---|---|---|---|
| 5,655,181 A | | 8/1997 | Chadani et al. | 399/114 |
| 5,761,584 A | | 6/1998 | Tsuda et al. | 399/258 |
| 5,802,431 A | | 9/1998 | Nagashima et al. | 399/262 |
| 5,832,343 A | | 11/1998 | Kobayashi et al. | 399/115 |
| 5,943,537 A | * | 8/1999 | Ahn | 399/254 |
| 6,064,844 A | * | 5/2000 | Isobe et al. | 399/119 |

FOREIGN PATENT DOCUMENTS

| | | | | |
|---|---|---|---|---|
| JP | 60229071 A | * | 11/1985 | G03G/15/08 |
| JP | 3-172873 | | 7/1991 | |
| JP | 4-115268 | | 4/1992 | |
| JP | 11219025 A | * | 8/1999 | G03G/15/08 |

* cited by examiner

*Primary Examiner*—Robert Beatty
(74) *Attorney, Agent, or Firm*—Fitzpatrick, Cella, Harper & Scinto

(57) ABSTRACT

A developing device includes a developer bearing member, and a developer container for containing a developer. The developer container includes a developer containing portion, a partition member dividing an interior of the developer containing portion into a plurality of rooms, and a cover for covering the developer containing portion, wherein the partition member is molded integrally with the cover. The partition member is disposed in parallel with a longitudinal direction of the developer bearing member and extended to form a gap between the partition member and a bottom surface of the developer containing portion throughout an entire length of the developer containing portion in a longitudinal direction of the developer bearing member. The developer containing portion includes a rib disposed in a direction intersecting the partition member and wherein the partition member includes a groove disposed in a direction so as to avoid intersecting the rib.

10 Claims, 9 Drawing Sheets

DEVELOPING DEVICE HAVING A COVER WITH PARTITION MEMBER

BACKGROUND OF THE INVENTION

1. Field of the Invention

The present invention relates to a developing device mounted in an image forming apparatus, such as a copying machine or a printer.

2. Related Art

When it has been used for a long period of time, an electrophotographic image forming apparatus requires adjusting, cleaning, and replacing operations. For example, it is necessary to replace the photosensitive drum, supply and replace the developer, and adjust, clean, and replace other components (such as the charger and the cleaner container). For a person other than a serviceperson with expertise, it has been virtually impossible to perform such maintenance operations.

In view of this, an image forming apparatus based on the electrophotographic image forming process adopts a process cartridge system, in which the electrophotographic photosensitive body and the process means acting thereon are integrated into a cartridge that is detachably attachable to the main body of the image forming apparatus. With this process cartridge system, the user can perform the maintenance of the apparatus by himself or herself without having to rely on a serviceperson, thus achieving a substantial improvement in terms of operability. That is why the process cartridge system is widely used in the field of image forming apparatuses.

FIG. 12 shows a conventional developing unit. A conventional developer unit 45 is formed by joining, by ultrasonic welding, a developing frame 43 supporting a developing member, such as a developing roller 48, with a toner containing frame body consisting of a toner container 46 in which agitating members 49 and a toner regulating plate 47 are provided and with which a toner container cover 44 is joined by ultrasonic welding.

In electrophotographic image forming apparatuses including such a process cartridge, there is a tendency toward an increase in the volume of the toner container and an increase in the size of the container for waste toner so that the service life of the process cartridge until its replacement may be prolonged.

However, when the volume of the toner container is increased, the weight of the toner increases. When the amount of developer is increased in the conventional image forming apparatus, the process cartridge may be dropped due to the weight of the toner, with the result that the toner sealing member is damaged to allow toner to leak. To avoid this, a toner regulating plate or the like, which is a separate component, has conventionally been provided in the toner container when forming the frame body.

However, this system has a problem in that it requires a separate component, resulting in high cost. Moreover, when the toner container cover is joined by ultrasonic welding, oscillatory welding or the like, with the toner regulating plate being mounted in the toner container, there is a danger that waste resin may be generated where the toner regulating plate and the toner container are in contact with each other and where the toner regulating plate and the toner container cover are in contact with each other, resulting in image disturbance.

SUMMARY OF THE INVENTION

The present invention has been made in view of the above problem. It is an object of the present invention to provide an inexpensive developing device.

Another object of the present invention is to provide a developing device which does not easily allow intrusion of impurities into the developer container at the time of production.

Still another object of the present invention is to provide a developing device comprising: a developer bearing member; and a developer container for containing a developer, the developer container including a developer containing portion, a partition member dividing an interior of the developer containing portion into a plurality of rooms, and a cover for covering the developer containing portion, wherein the partition member is molded integrally with the cover.

Other objects of the present invention will become apparent from the following detailed description with reference to the accompanying drawings.

DESCRIPTION OF THE PREFERRED EMBODIMENTS

Embodiments of the present invention will be described with reference to FIGS. 1 through 11. In these embodiments, the term "longitudinal direction" refers to a direction perpendicular to the direction in which the recording medium is conveyed and parallel to the plane of the recording medium.

(Description of Process Cartridge and Apparatus Main Body)

Figure 1:
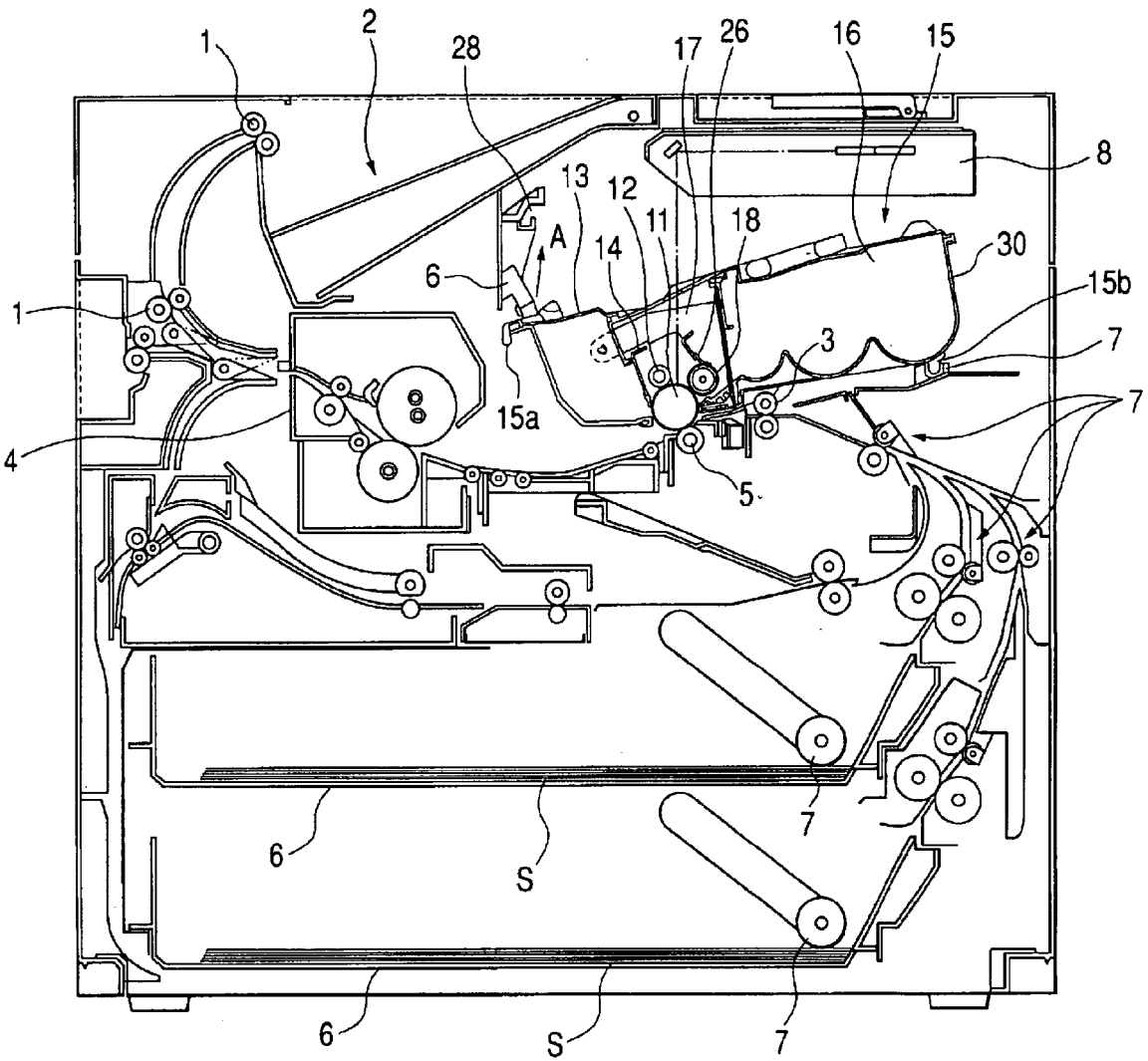
FIG. 1 is a longitudinal sectional view of an image forming apparatus.
Figure 2:
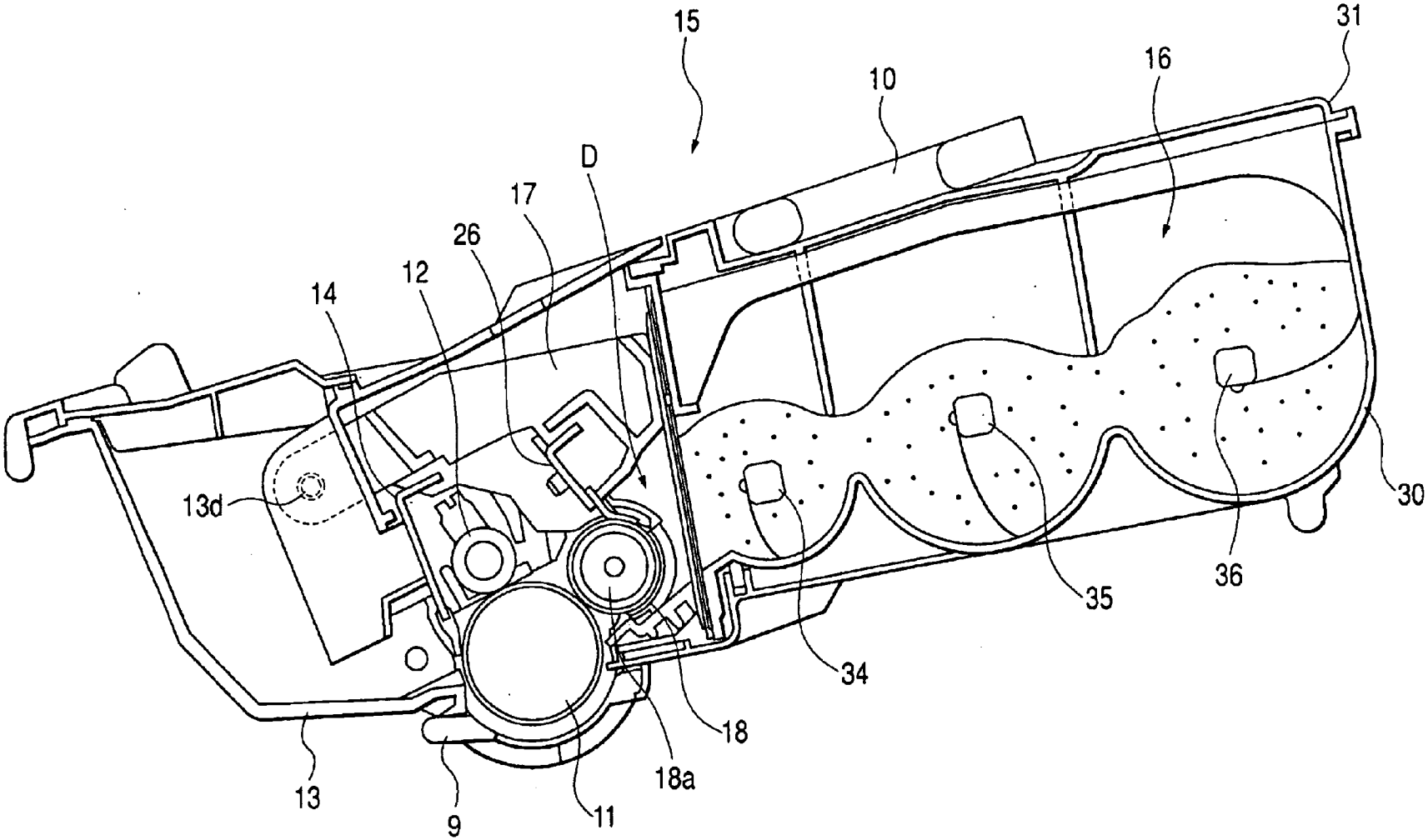
FIG. 2 is a schematic main sectional view of a process cartridge according to an embodiment of the present invention.

FIG. 1 is a main sectional view of an image forming apparatus according to the present invention, and FIG. 2 is a main sectional view of a process cartridge according to the present invention. This process cartridge is equipped with an image bearing member and process means acting on the image bearing member. The process means include, for example, charging means for charging the surface of the image bearing member, a developing device for forming a toner image on the image bearing member, and cleaning means for removing residual toner from the surface of the image bearing member. The process cartridge has only to be equipped with the image bearing member and at least one of the process means.

As shown in FIG. 2, the process cartridge 15 of this embodiment includes a cleaning frame body 13 containing an electrophotographic photosensitive drum (hereinafter referred to as the photosensitive drum) 11, around which there are provided a charging roller 12 serving as the charging means and a cleaning blade 14 serving as the cleaning means, a drum protecting shutter 9 for protecting the photosensitive drum 11, a developing frame body 17 containing a developing roller 18 and a developing blade 26 serving as the developing device, and a toner containing unit 16 for containing toner serving as the developer, the toner containing unit 16 being formed by welding a toner container 30 containing agitating members 34, 35, and 36 as rotating members for agitating the toner, to a toner container cover 31. These components are integrated into the process cartridge 15, and a handle 10 is provided on top of the toner container cover 31, whereby the process cartridge is detachably attachable to the main body of the image forming apparatus, without applying excessive force to the process means.

This process cartridge 15 is attached to the image forming apparatus as shown in FIG. 1 for image formation. A sheet S serving as the recording medium is conveyed from a sheet cassette 6 mounted in the lower portion of the apparatus to a transfer position on the photosensitive drum 11 by conveying rollers 7, an image being transferred to the sheet S.

The photosensitive drum 11 is charged by the charging roller 12, and then selective exposure is effected by an exposing device 8 in accordance with the image information to form an electrostatic latent image. The exposure is effected in synchronism with the sheet conveyance by a registration roller 3.

Thereafter, toner contained in the toner containing unit 16 is carried to the developing frame body 17 side, and this toner is borne in a thin layer on the surface of the developing roller 18 by the developing blade 26, and a developing bias is applied to the developing roller 18, whereby toner is supplied from the developing roller 18 to the photosensitive drum 11 in accordance with the latent image. The toner image formed on the photosensitive drum 11 is transferred to the sheet S being conveyed through application of bias voltage to the transferring roller 5 at the transferring position. The sheet S is conveyed to a fixing apparatus 4 for image fixation, and discharged onto a discharging portion 2 in the upper portion of the apparatus by sheet discharging rollers 1. After the transfer, the residual toner on the photosensitive drum 11 is removed by the cleaning blade 14 and collected in the cleaning frame body 13.

Frame Body Structure of Process Cartridge

The structure around the developing device will be described in detail.

Figure 3:
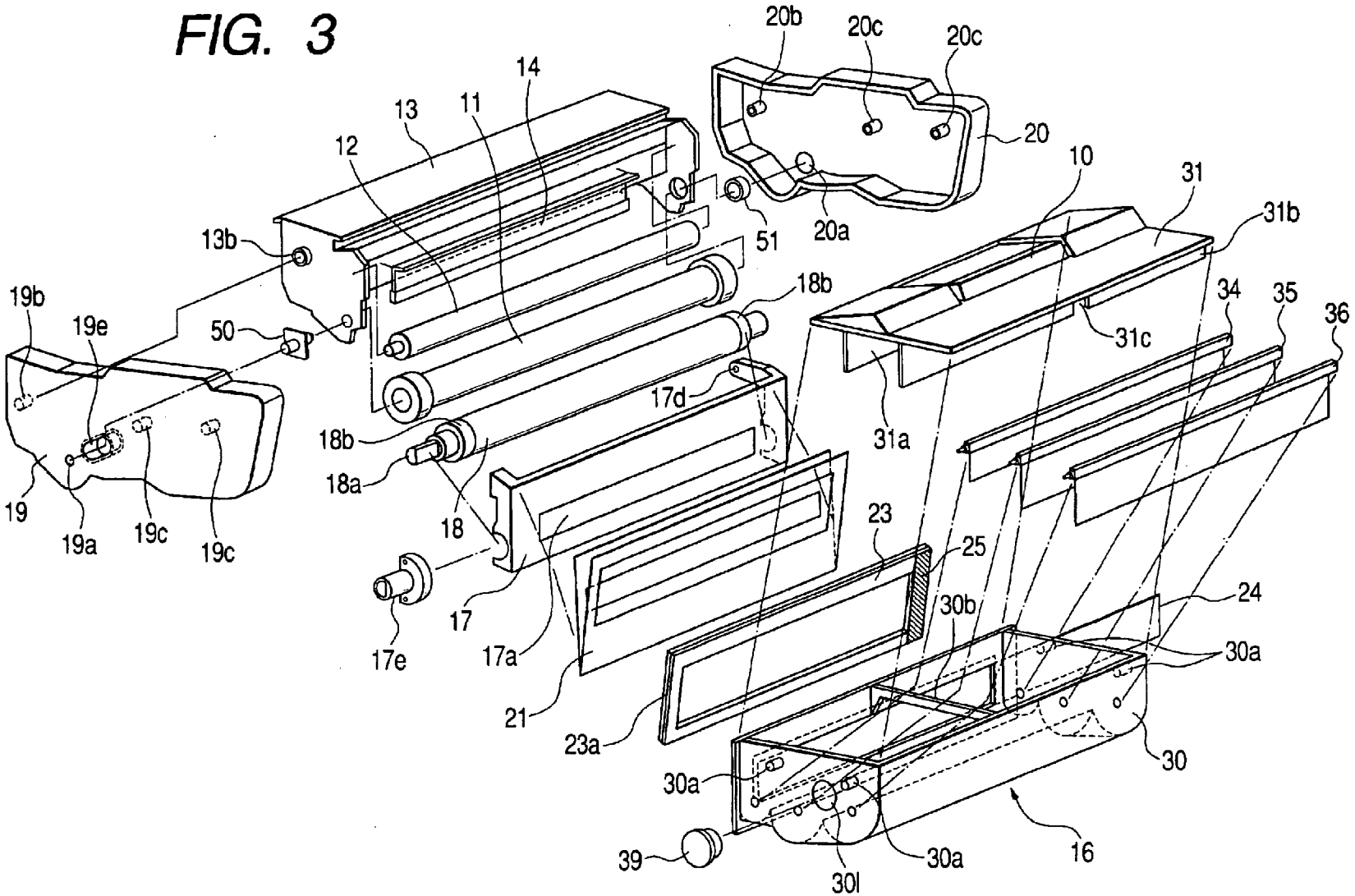
FIG. 3 is an exploded perspective view of a process cartridge according to an embodiment of the present invention.

FIGS. 2 and 3 schematically show the structure of the process cartridge 15 of this embodiment. The developing device D of the process cartridge 15 bears toner contained in the toner containing unit 16 on the surface of the developing roller 18 serving as the toner bearing member, and by applying a developing bias to the developing roller 18, toner is supplied in accordance with the latent image formed on the photosensitive drum 11.

The developing roller 18 is formed as a cylindrical metal member of aluminum, stainless steel or the like, and contains a magnet roller 18*a*.

FIG. 3 is a schematic exploded view showing the structure of the process cartridge. Positioning pins 30*a* of the toner container 30 are fitted into bosses 19*c* and 20*c* of side covers 19 and 20, whereby positioning of the toner containing unit 16 is effected with respect to the side covers 19 and 20 for fixation to the side covers 19 and 20. The photosensitive drum 11 is rotatably supported by a bearing pin 50 and a bearing 51, and a positioning boss 13*b* and a positioning pin 19*b* are engaged with each other, the bearing pin 50 fixed to the cleaning frame body 13 being fitted into a hole 19*a* of the side cover 19, whereby the cleaning frame body 13 is fixed to the side cover 19 like the toner containing unit 16. Positioning of the side cover 20 and the cleaning frame body 13 is effected in the same manner as on the side cover 19 side. Thus, the cleaning frame body 13 and the toner containing unit 16 are integrally fixed through the side covers 19 and 20.

Figure 6:
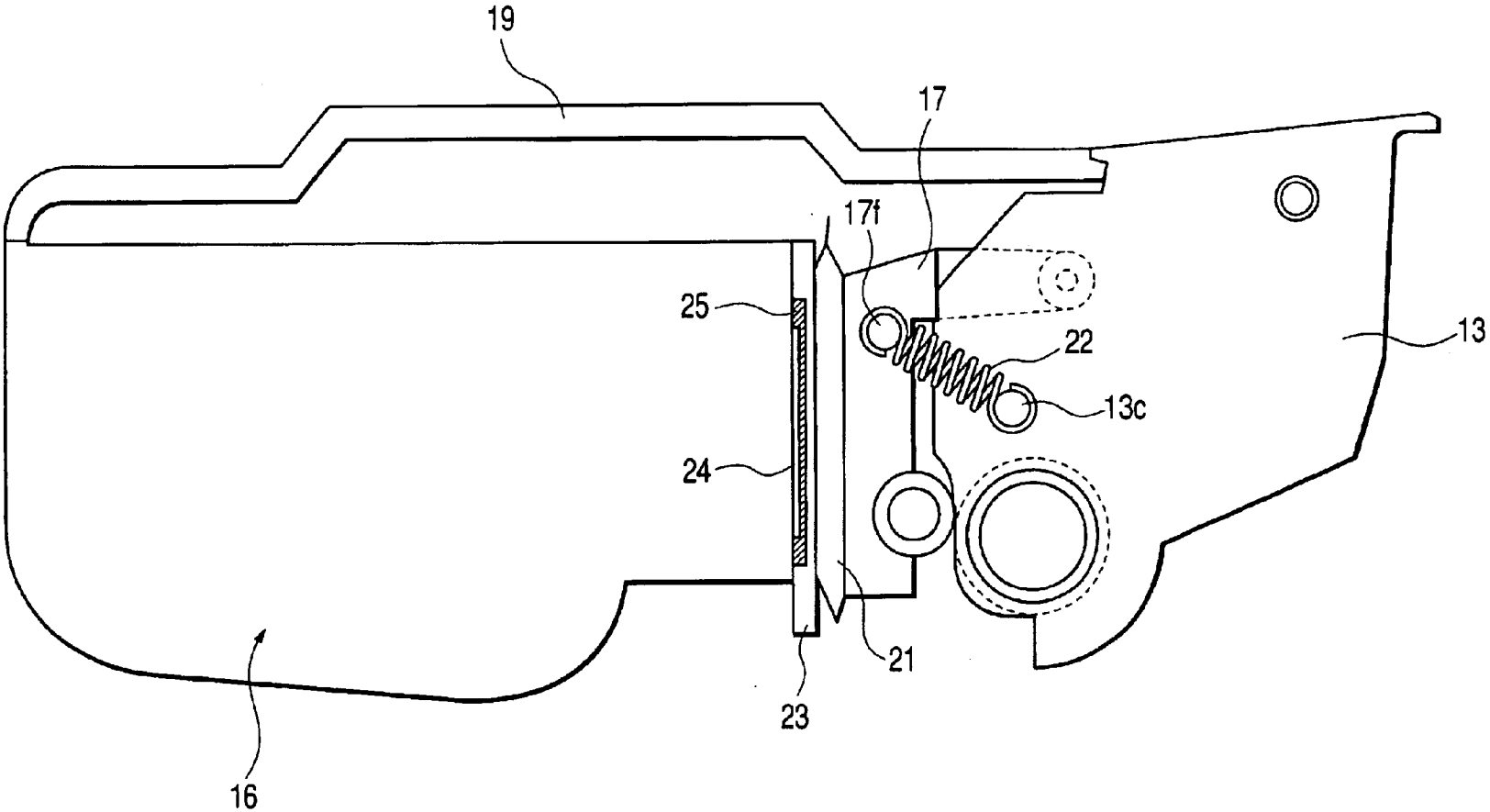
FIG. 6 is a side view of a process cartridge according to an embodiment of the present invention.
Figure 7:
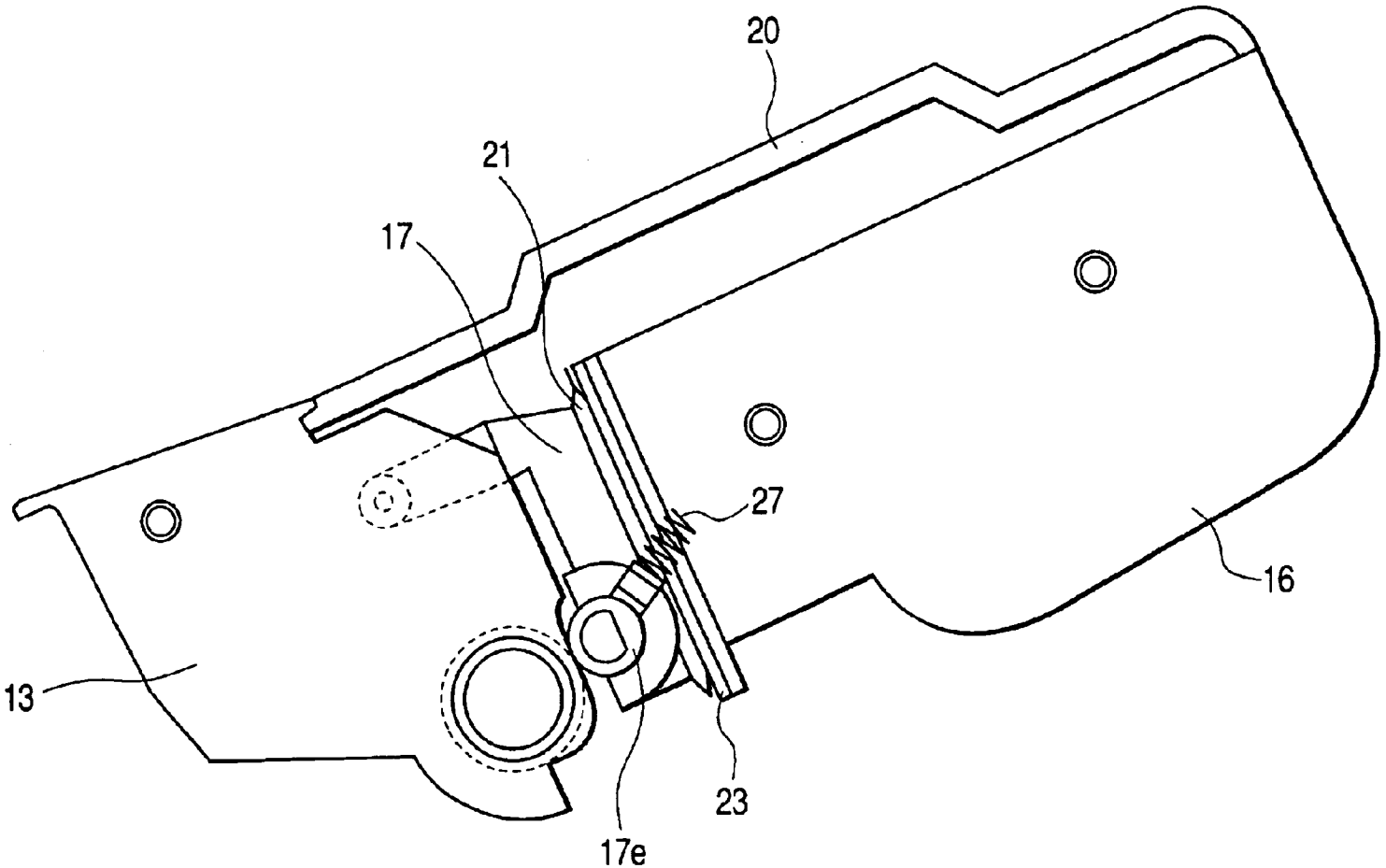
FIG. 7 is a side view of a process cartridge according to an embodiment of the present invention.
Figure 8:
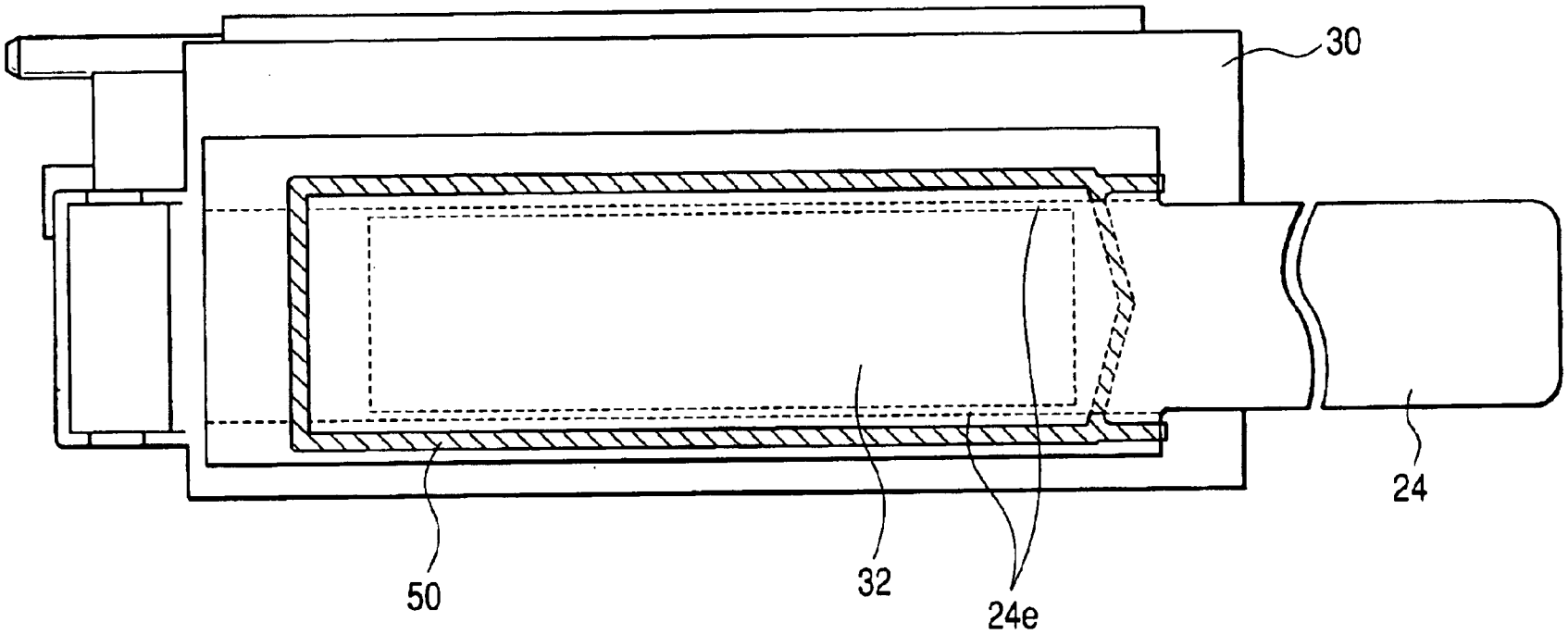
FIG. 8 is a front view of a toner discharge opening of a toner container according to an embodiment of the present invention.

Further, as shown in FIG. 2, the developing frame body 17 of the developing device D, which supports the developing members, such as the developing roller 18 and the developing blade 26, is supported by a suspension hole 13*d* of the cleaning frame body 13 so as to be swingable about a suspension hole 17*d*. In addition, as shown in FIG. 6, in which the side cover 20 is omitted, a helical tension spring 22 is stretched between a spring peg 13*c* protruding from the cleaning frame body 13 and a spring peg 17*f* protruding from the developing frame body 17.

Further, inside the side cover 19, a compression coil spring 27 (FIG. 7) is arranged so as to pressurize a developing roller bearing 17*e*. The developing roller bearing 17*e* is movably engaged with an elongated hole 19*e* of the side cover 19 directed in the radial direction of the photosensitive drum 11. By the resilient force of the compression coil spring 27 and the helical tension spring 22, abutting rollers 18*b* which are provided at the both ends of the developing roller 18 and concentric therewith and whose radius is larger than that of the developing roller 18 by the developing gap (approximately 300 $\mu$m) are in pressure contact with the portions of the photosensitive drum 11 outside the image area.

A gap is defined between the developing frame body 17 and the toner container 30. Further, the lower portion of the surface of the toner container 30 facing the developing frame body 17 extends along a substantially horizontal line.

In this embodiment, the gap between the developing device D and the toner container 16 is sealed. A sealing member is formed by bonding sheet members with each other into a bellows-like shape, and is mounted through the intermediation of a plate member. In this case, the thickness of the sheet members is not more than 1 mm. However, the thickness may be 1 mm or more as long as the material selected is one which does not lead to deterioration in the flexibility of the bellows-like shape.

Figure 4:
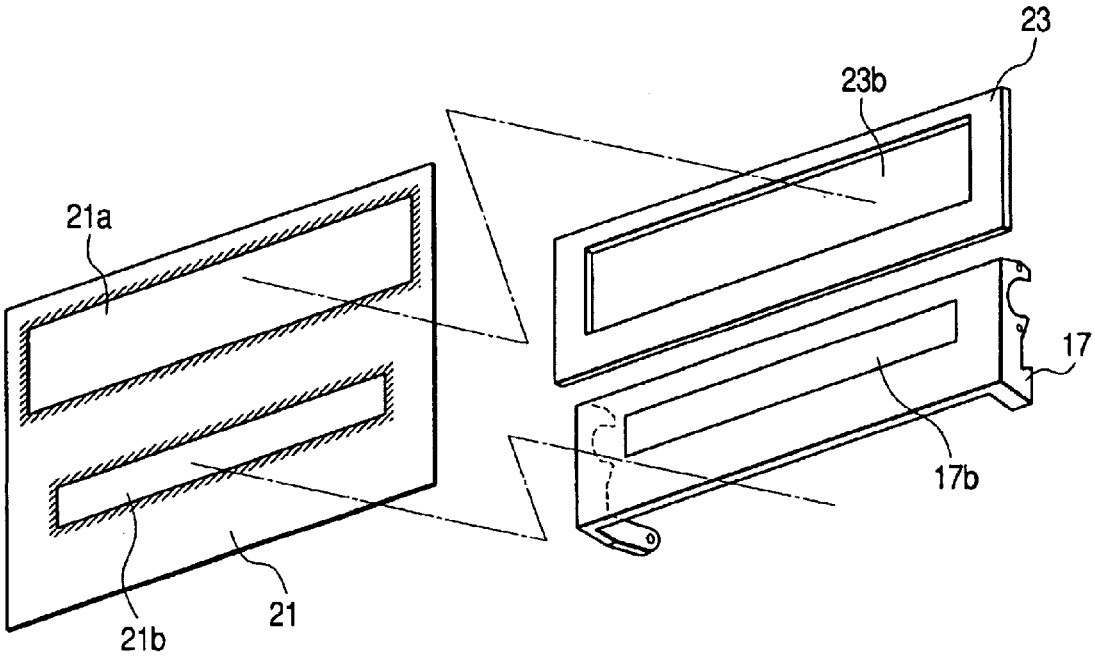
FIG. 4 is a perspective view of a sealing member according to an embodiment of the present invention.
Figure 5:
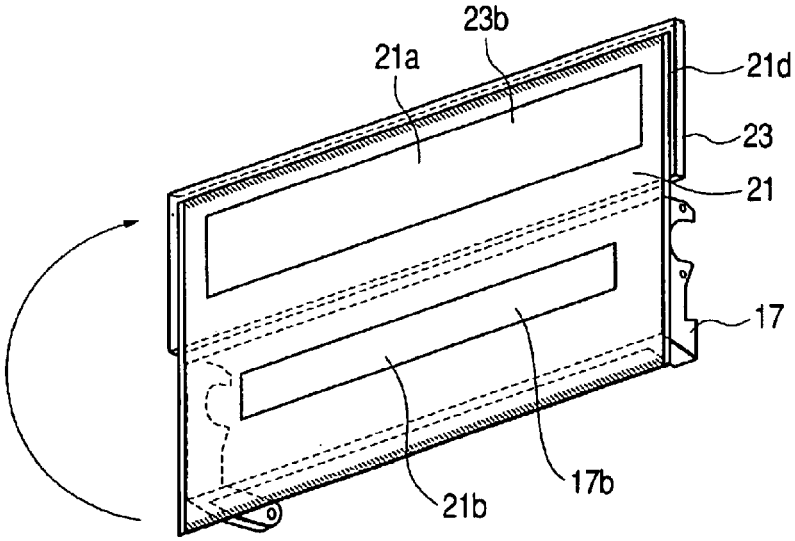
FIG. 5 is a perspective view of a sealing member according to an embodiment of the present invention.

Next, FIGS. 4 and 5 schematically show a process for forming a bag-like sealing member of a sheet member.

As shown in FIG. 4, a sheet member 21 has openings 21*a* and 21*b* whose area is substantially the same as or larger than the area of an opening 23*b* of a plate-like member 23 and an opening 17*b* of the developing frame body 17. This sheet member 21 is joined with the plate member 23 and the developing frame body 17 such that the openings 23*b* and 17*b* are closed (as indicated by the shaded portions).

In this embodiment, the sheet member 21 is joined with the developing frame body 17 and the plate-like member 23 by a thermal welding method, such as heat sealing or impulse sealing. It is also possible to adopt ultrasonic welding, adhesive, an adhesive tape or the like.

Next, as shown in FIG. 5, after being attached to the developing container 17 and the plate-like member 23, the sheet member 23 is bent in the direction of the arrow such that the openings face each other, forming a bellows (bag-like shape). The end portions 21*d* (the shaded portions) of the surface contacting each other through bending are joined with each other for sealing. The sealing means may be thermal welding, such as heat sealing or impulse sealing. It is also possible to adopt ultrasonic welding, adhesive, or adhesive tape.

Next, the plate-like member 23 is mounted to the toner container 30. At this time, a part of the mounting portion is not welded or sealed so as to allow passage of a toner seal member 24.

In this embodiment, the portion 23*a* shown in FIG. 3 is welded, whereas the region where the toner sealing member 25 pressurizes the toner seal member 24 is not welded or sealed.

With this arrangement, the sealing member 21 completed by using the sheet member 21 (the sheet member and the completed sealing member are indicated by the same reference numeral) is in the form of a bag-like shape, so that if the distance between the opposing surfaces of the toner container 30 and the developing frame body 17 varies, it is possible to minimize the resistance at the time of displacement. Further, by mounting the sealing member 21 between the plate-like member 23 and the developing frame body 17, it is possible for the plate-like member 23 to cover the toner seal member 24, so that it is possible to mount the toner sealing member 25 in the gap where the toner seal member 24 passes, whereby toner leakage can be prevented.

Further, as compared with the case in which the plate-like member 23 and the developing frame body 17 are directly attached to the toner container 30 for sealing in the same plane, it is possible to simplify the structure of the requisite welding pedestal.

Further, due to the presence of the plate-like member 23, formation in an integral unit with the developing frame body 17 is possible, facilitating the mounting of the sealing member 21 to the toner containing unit 16.

Attachment and Detachment of Process Cartridge to and from Apparatus Main Body

FIG. 1 shows a state in which the process cartridge 15 can perform image formation. To detach the process cartridge 15 in the state shown in FIG. 1, an operating lever (not shown) provided on the front side of the apparatus main body is rotated. Then, a swinging arm 6 accordingly rotates in the direction of the arrow A, and the left-hand side of the process cartridge 15 is raised by the forward end of this arm 6. At this time, the left-hand portion of the process cartridge 15 swings about a fulcrum 15*b* located on a guide rail 7 and is raised to cause a guide portion 15*a* existing only on the inner side of the process cartridge 15 to be brought to the same level as a guide rail 28 of the apparatus main body. When, in this condition, the process cartridge 15 is pulled to the front in a direction perpendicular to the plane of FIG. 1, the guide portion 15*a* is transferred to the guide rail 28, and then the support of the process cartridge 15 by the arm 6 is released. The process cartridge 15, drawn as it is, can be extracted to the exterior of the apparatus main body.

The attachment of the process cartridge 15 to the apparatus main body is effected by a process reverse to the above. The guide portion 15*a* and the fulcrum 15*b* are put inward in a direction perpendicular to the plane of FIG. 1 in conformity with the guide rails 28 and 7, respectively. Then, the left upper portion of the process cartridge 15 is supported by the arm 6 before the guide portion 15*a* has been detached from the guide rail 28, and when the process cartridge 15 is further pushed in, the guide portion 15*a* is detached from the guide rail 28. Here, a lock (not shown) locking the arm 6 is released, and the arm 6 is rotated in a direction reverse to the arrow A by the operating lever (not shown) on the front side of the apparatus main body. The weight of the process cartridge 15 also contributes to this rotation.

When the process cartridge 15 is brought close to the position allowing image formation, a bearing pin 50 outwardly protruding from a hole 19*a* of the side cover 19 shown in FIG. 3 (on the side cover 20 side also, a bearing 51 protrudes to the exterior of the side cover 20) is fitted into a positioning recess (not shown) for positioning. With this arrangement, the position of the photosensitive drum 11 is correctly determined with respect to the apparatus main body since the photosensitive drum 11, the bearing pin 50, and the bearing 51 are provided coaxially with each other. The process cartridge 15 thus formed can be attached to and detached from the apparatus main body in a good condition even if the toner container 30 contains a great amount of toner and is heavy. Apart from the upper handle 10, the process cartridge 15 has a handle (not shown) on the front side with respect to the attachment/detachment direction, and provides a satisfactory operability in carrying about and at the start of the attachment and the end of the detachment to and from the apparatus main body.

Description of Toner Containing Unit

Next, the toner containing unit 16 will be described with reference to FIGS. 8 through 11. The toner containing unit 16 is composed of the toner container 30, the toner container cover 31, and the agitating members 34, 35, and 36. The toner container 30 is equipped with an opening 32 for supplying toner to the developing frame body 17. The opening 32 is covered with a toner seal member 24. The toner seal member 24 is fused and welded to the toner containing frame body 16 at a welding portion 50 (shaded portion) around the opening 32 so as to cover the opening 32 (See FIG. 8). The opening 32 is open in the lateral direction in order to supply toner to the developing roller 18 or the like which constitutes the developing means.

Here, the toner seal member 24 is folded back in the longitudinal direction of the opening 32 (the direction which is the same as the longitudinal direction of the photosensitive drum 11) and superimposed on the portion covering the opening 32, its end portion being drawn out of the cartridge frame body (side cover 20) as shown in FIG. 3.

Figure 9:
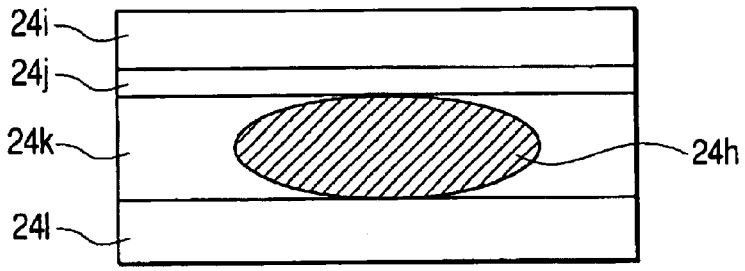
FIG. 9 is a sectional view of a toner sealing member according to an embodiment of the present invention.

In this embodiment, the toner seal member 24 is composed of the following layers:

- polyester layer, 12 $\mu$m (strength maintaining layer, indicated at 24*i* in FIG. 9);
- aluminum foil, 7 $\mu$m (laser intercepting layer, indicated at 24*j* in FIG. 9);
- polyester layer, 50 $\mu$m (ripping guide layer, indicated at 24*k* in FIG. 9); and
- sealant layer, 50 $\mu$m (container connecting layer, indicated at 24*l* in FIG. 9).

A ripping portion 24*e* for opening (See FIG. 8) is formed by laser cut processing in which a carbon dioxide laser is applied from the sealant layer side to fuse a part of the ripping guide layer 24*k* consisting of a polyester layer and the sealant layer (24*l*), thereby forming a gap portion 24*h* (FIG. 9 is a sectional view of a seal member, showing the gap portion 24*h* formed by laser processing). Since the laser is intercepted by the aluminum foil layer 24*j*, the uppermost layer, i.e., the polyester layer (24*i*) is not damaged, making it possible to secure a sufficient sealing property. At the time of opening, stress is concentrated on the gap portion 24*h* formed by laser processing, so that it is possible to perform ripping reliably along the ripping portion 24*e* to effect opening.

Further, provided in the toner container 30 are the agitating members 34, 35, and 36 for carrying toner from the opening 32 into the developing frame body 17 and agitating it. In the agitating members 34, 35, and 36, flexible sheet members 34*a*, 35*a*, and 36*a* are fixed to agitating bars 34*c*, 35*c*, and 36*c* by sheet presser members 34*b*, 35*b*, and 36*b*. In this embodiment, the sheet member 34*a* is a PPS sheet material having a thickness of approximately 50 $\mu$m, and the sheet members 35*a* and 36*a* are PPS sheet members having a thickness of approximately 100 $\mu$m. All the agitating members 34, 35, and 36 rotate in the same direction (clockwise in FIG. 2). The agitating member 34 nearest to the developing frame body 17 rotates at approximately 20 rpm, and the remaining agitating members 35 and 36 rotate at approximately 5 rpm.

Figure 10:
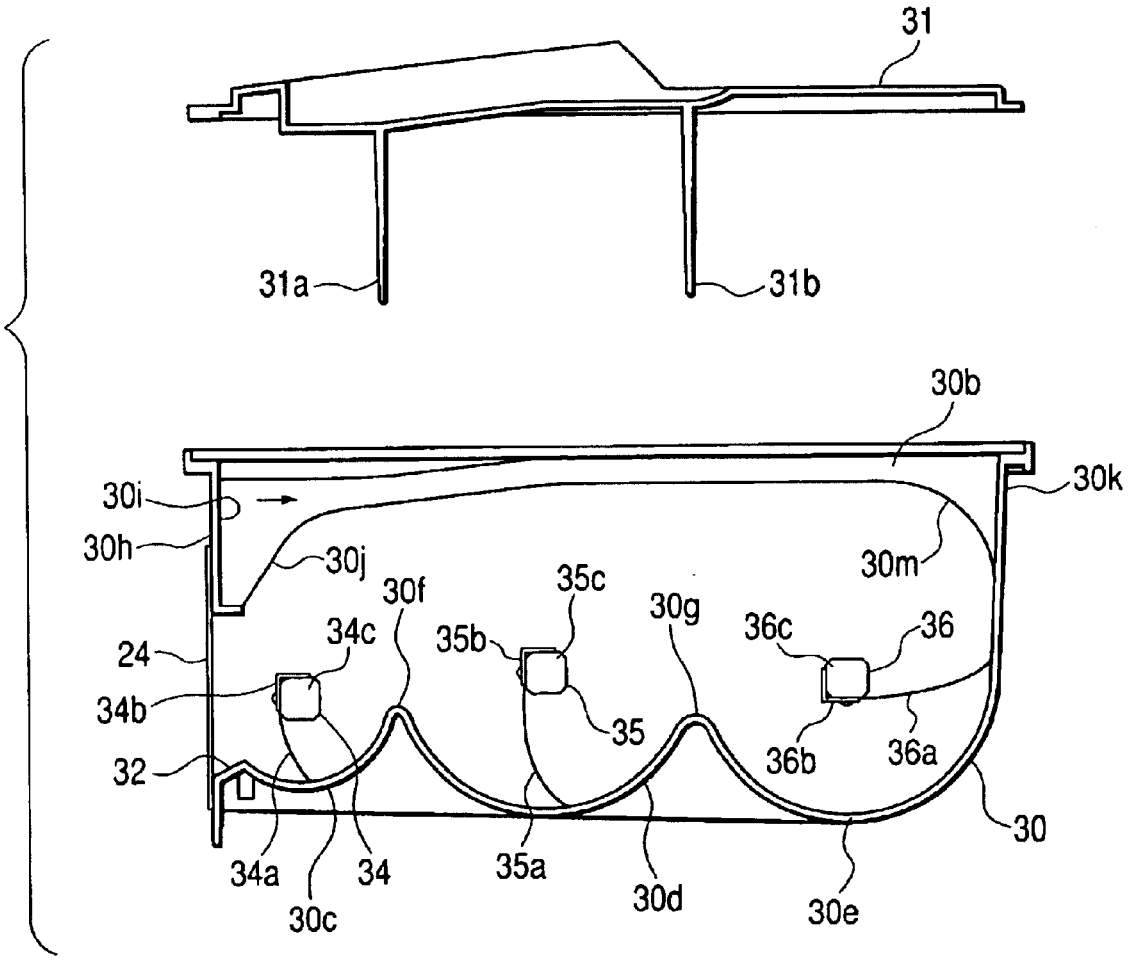
FIG. 10 is a longitudinal sectional view of a toner containing unit according to an embodiment of the present invention in a state before welding.
Figure 11:
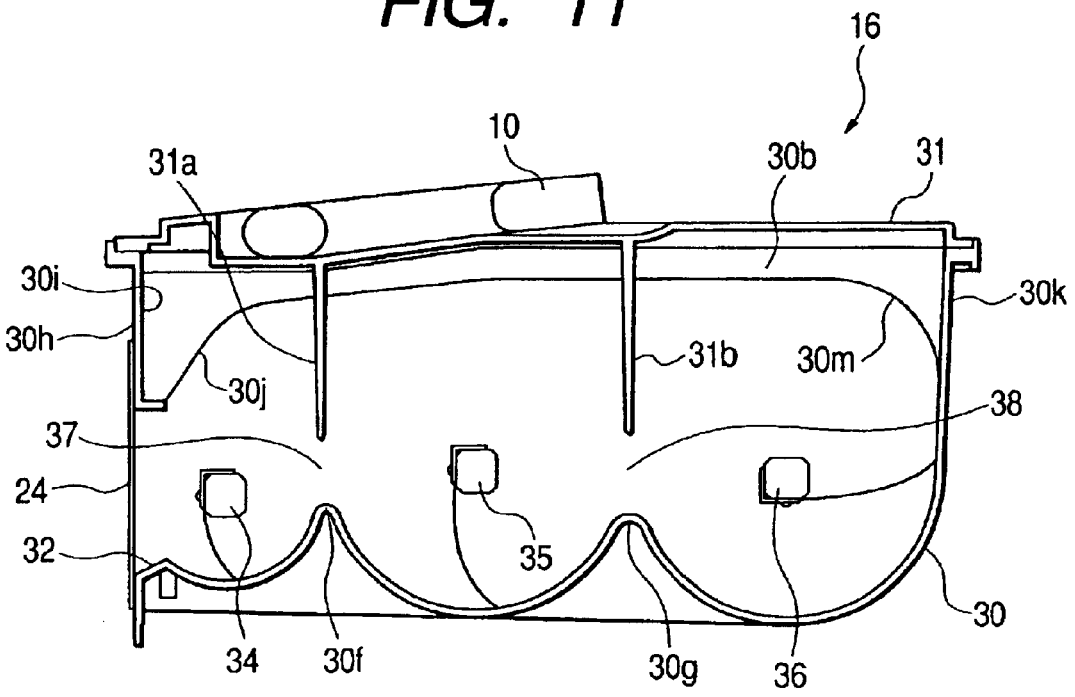
FIG. 11 is a longitudinal sectional view of a toner containing unit according to an embodiment of the present invention in a state after welding.
Figure 12:
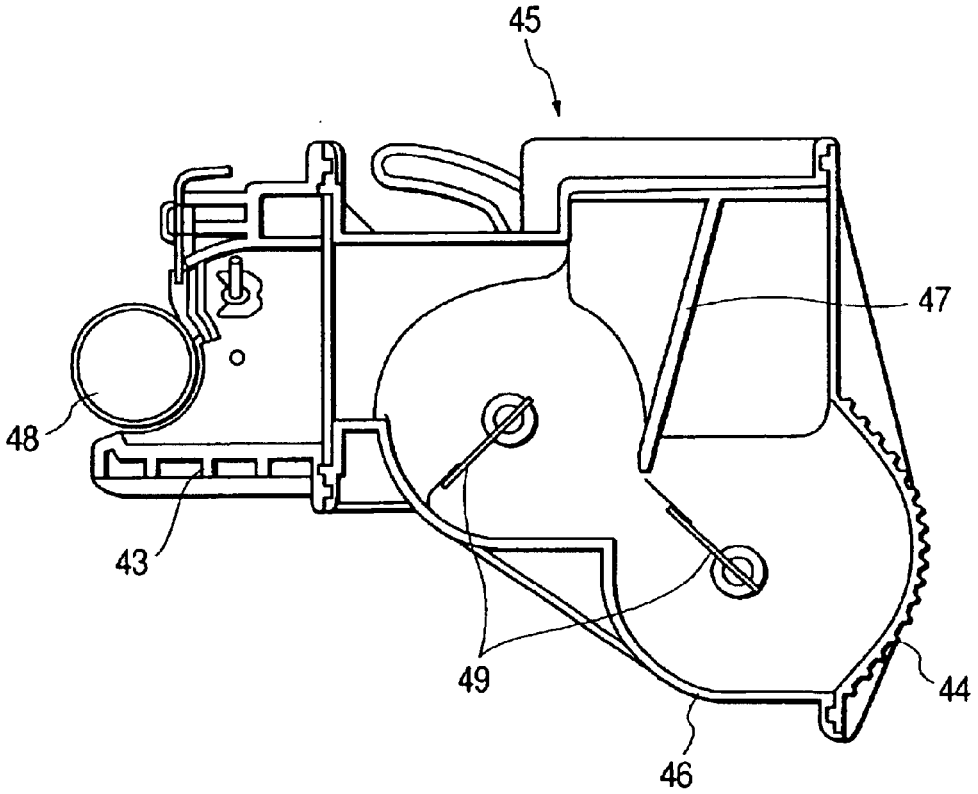
FIG. 12 PRIOR ART
FIG. 12 is a schematic main sectional view of a conventional process cartridge.

As shown in FIG. 10, the bottom surface of the toner container 30 has a sectional shape such that it exhibits semi-circular portions 30*c*, 30*d*, and 30*e*. The semi-circular sectional shape of the bottom surface of the toner container 30 provides the following advantage: by making the rotation radius of the agitating members 34, 35, and 36 larger than the radius of the bottom surface, it is possible for the sheet members to agitate the toner while scraping the bottom surface, whereby the consumption of toner is promoted, and when the toner amount has been reduced, the toner at the bottom surface can be scraped off and carried to the developing frame body 17, enabling to reduce the amount of the residue toner. In this embodiment, the amount by which the sheet members 34*a*, 35*a*, and 36*a* enter the semi-circular portions 30*c*, 30*d*, and 30*e* is 2 to 4 mm.

The toner container 30 has the other end surface 30*k* which is substantially parallel to the back side 30*i* of the surface 30*h* to which the plate-like member 23 is mounted.

In the toner container 30, there is provided a bridge-like rib 30*b* which extends from the back side 30*i* of the surface 30*h* to which the plate-like member 23 of the opening 32 for discharging toner to the other end surface 30*k* of the toner container 30. The bridge-like rib 30*b* has an inclined surface 30*j* extending upwardly to a position where it is not in the way when incorporating the agitating member 34 into the toner container 30. It further extends to the other end surface 30*k* of the toner container so as not to interfere with the toner agitating members 34, 35, and 36, and is connected to the other end surface 30*k* through an arcuate portion 30*m*. The bridge-like rib 30*b* is provided substantially at the center with respect to the longitudinal direction of the toner container 30 (the direction perpendicular to the plane of FIG. 10). The bridge-like rib 30*b* serving as a bridge-like portion has a plate-like sectional shape. It may also have, for example, a T-shaped, I-shaped, H-shaped, circular, or U-shaped sectional shape.

On the toner container side of the toner container cover 31, there are provided cutoff ribs (partition members) 31*a* and 31*b* so as to be integrated, which are at positions substantially matched with the protrusions 30*f* and 30*g* of the bottom surface of the toner container and which extend toward the longitudinal direction. The central portions 31*c* of the cutoff ribs 31*a* and 31*b* are formed as cutouts so that they may not interfere with the bridge-like rib 30*b* in the toner container (See FIG. 3).

Then, after incorporating the agitating members 34, 35, and 36 into the toner container 30, the toner container cover 31 and the toner container 30 are welded to each other to form the toner containing unit 16. The gaps 37 and 38 between the cutoff ribs 31*a* and 31*b* and the protrusions 30*f* and 30*g* are of a dimension required for sending out toner. In this embodiment, it is approximately 10 to 16 mm.

The toner containing unit is formed as described above, and toner is filled from a toner filling 30*l* of the toner container 30 shown in FIG. 3, and sealed by a toner cap 39, thus completing the toner containing unit 16.

The toner container 30 and the toner container cover 31 are formed of a resin, such as HIPS (High Impact Polystyrene).

As described above, the toner container 30 contains toner (developer), and has the opening 32 open in the lateral direction for toner supply to the developing roller 18 serving as the developing means, and the cutoff ribs extending substantially parallel to the opening 32 toward the interior of the container from the toner container cover 31 of the upper surface. Thus, unlike the case in which the cutoff ribs are prepared as separate members and welded to the toner container, there is no danger that waste resin is mixed with the toner, thus preventing image disturbance.

Since the toner container is composed of the toner container main body (30) and the toner container cover 31 and the cutoff ribs 31*a* and 31*b* are provided on the toner container cover, resin molding is easy to perform, thereby facilitating the assembly and achieving a reduction in cost.

Since the toner container cover 31 is welded to the toner container main body (30), the cutoff ribs require no assembly man-hour, thereby contributing to a reduction in cost.

There are provided the semi-circular portions 30*c*, 30*d*, and 30*e*, which are recesses ranging toward the opening 32, and the agitating members 34, 35, and 36 which are provided in the recesses and which send out toner toward the opening 32, with the cutoff ribs 31*a* and 31*b* extending toward the protrusions 30*f* and 30*g* substantially constituting the borders between the adjacent recesses. Thus, a plurality of rooms can be easily formed inside the toner container.

There are the gaps 37 and 38 between the protrusions 30*f* and 30*g* substantially constituting the borders between the semi-circular portions 30*c*, 30*d*, and 30*e*, which are adjacent recesses, and the cutoff ribs 31*a* and 31*b*, whereby it is possible to send toner to the adjacent rooms through these gaps by using the agitating members, and it is possible to prevent the toner from clustering on the opening 32 side when handling the toner container. Thus, even if the position of the toner container 30 is such that the toner seal member 24 is on the lower side, it is possible to reduce the load on the toner seal member 24 due to the weight of the toner.

By making the dimension of the gaps between the protrusions substantially constituting the borders of the adjacent recesses and the ribs approximately 10 to 16 mm, it is possible to move an appropriate amount of toner to the adjacent rooms by the agitating members, and the displacement of toner toward the opening 32 when handling the toner container is restricted.

What has been described above applies not only to a toner container singly used but also to a process cartridge having such a toner container.

As is apparent from the above description, in accordance with the present invention, a developer container contains developer and has an laterally extending opening for supplying developer to developing means and ribs extending from above into the interior of the container so as to be substantially parallel to the opening, so that it is possible to control the toner movement without using any separate member, making it possible to protect the toner seal member from any impact during transportation or upon falling. Further, since there is no need to use any separate member, it is possible to provide a developer container and a process cartridge which are inexpensive and highly reliable.

While the invention has been described with reference to the structure disclosed herein, it is not confined to the details set forth and this application is intended to cover such modifications or changes as may come within the purposes of the improvements or the scope of the following claims.

What is claimed is:

1. A developing device comprising:

a developer bearing member; and a developer container for containing a developer, said developer container including a developer containing portion, a partition member dividing an interior of said developer containing portion into a plurality of rooms, and a cover for covering said developer containing portion, wherein said partition member is molded integrally with said cover, wherein said containing portion includes a rib disposed in a direction intersecting said partition member; and wherein said partition member includes a groove disposed in a direction so as to avoid intersecting said rib.

2. A developing device according to claim 1, wherein said partition member divides the interior of said developer containing portion into said plurality of rooms except for a gap through, which allows the developer to pass among said plurality of rooms.

3. A developing device according to claim 1 or 2, wherein said partition member is formed as a plate in parallel with said developer bearing member.

4. A developing device according to claim 3, wherein a plurality of developer conveyors for conveying the developer are respectively provided in said plurality of rooms.

5. A developing device according to claim 3, wherein said developing device is detachably attachable to an image forming apparatus for forming an image on a recording material.

6. A developing device according to claim 5, wherein said developing device and an image bearing member for bearing an image are formed into an integral unit.

7. A process cartridge detachably attachable to a main body of an image forming apparatus, said process cartridge comprising:

a photosensitive drum; and a developing device for developing a latent image formed on said photosensitive drum, said developing device comprising:

a developer bearing member; and a developer container for containing a developer, said developer container including a developer containing portion, a partition member dividing an interior of said developer containing portion into a plurality of rooms, and a cover for covering said developer containing portion, wherein said partition member is molded integrally with said cover, wherein said containing portion includes a rib disposed in a direction intersecting said partition member; and wherein said partition member includes a groove disposed in a direction so as to avoid intersecting said rib.

8. A process cartridge according to claim 7, wherein said partition member divides the interior of said developer containing portion into said plurality of rooms except for a gap through, which allows the developer to pass among said plurality of rooms.

9. A process cartridge according to claim 7 or 8, wherein said partition member is formed as a plate in parallel with said developer bearing member.

10. A process cartridge according to claim 9, wherein a plurality of developer conveyors for conveying the developer are respectively provided in said plurality of rooms.

* * * * *

UNITED STATES PATENT AND TRADEMARK OFFICE

CERTIFICATE OF CORRECTION

PATENT NO. : 6,760,558 B2
DATED : July 6, 2004
INVENTOR(S) : Kazuo Chadani et al.

It is certified that error appears in the above-identified patent and that said Letters Patent is hereby corrected as shown below:

Title page,
Item [56], References Cited, U.S. PATENT DOCUMENTS,
"60229071" should read -- 60-229071 --; and
"11219025" should read -- 11-219025 --.

Signed and Sealed this

Fifteenth Day of February, 2005

JON W. DUDAS
*Director of the United States Patent and Trademark Office*